US006678634B1

(12) United States Patent
Wendt et al.

(10) Patent No.: US 6,678,634 B1
(45) Date of Patent: Jan. 13, 2004

(54) THICKNESS MEASUREMENT SYSTEM AND METHOD

(75) Inventors: John F. Wendt, Columbus, OH (US); Ulrich Lang, Upper Arlington, OH (US); Leeman D. Spradlin, Columbus, OH (US); Ronald N. Geiger, Columbus, OH (US); James Ronald Fry, Columbus, OH (US); Stephen J. Kiernan, Columbus, OH (US)

(73) Assignee: Automation and Control Technology, Inc., Columbus, OH (US)

( * ) Notice: Subject to any disclaimer, the term of this patent is extended or adjusted under 35 U.S.C. 154(b) by 39 days.

(21) Appl. No.: 09/844,467

(22) Filed: Apr. 27, 2001

(51) Int. Cl.[7] ..... G06F 9/00

(52) U.S. Cl. ..... 702/170; 702/162; 702/179; 702/188

(58) Field of Search ..... 702/162, 170, 702/179, 182, 188; 72/9, 16.9, 18.8

(56) References Cited

U.S. PATENT DOCUMENTS 5,345,309 A * 9/1994 Wertz et al. ..... 356/372
5,351,203 A 9/1994 Hoffman et al. ..... 364/560
5,423,199 A 6/1995 Mangrulkar ..... 72/3
5,735,055 A 4/1998 Hochbein et al. ..... 33/554
5,769,540 A * 6/1998 Schietinger et al. ..... 374/127
5,862,199 A 1/1999 MacKenzie ..... 378/89
5,864,601 A 1/1999 Cattorini et al. ..... 378/59
6,067,161 A * 5/2000 Marcus et al. ..... 356/357
6,118,844 A 9/2000 Fischer ..... 378/48
6,401,506 B1 * 6/2002 Ogawa et al. ..... 72/14.4
6,452,179 B1 * 9/2002 Coates et al. ..... 250/339.09

* cited by examiner

*Primary Examiner*—Marc S. Hoff
*Assistant Examiner*—Felix Suarez
(74) *Attorney, Agent, or Firm*—Standley Law Group LLP

(57) ABSTRACT

A system and method for frequent and accurate measuring of flat sheet thickness on a process line is disclosed. The results of the monitoring process of the present invention may be used to adjust the production process to better remain within predetermined tolerances. Data collection, data analysis, and process control are accomplished using a plurality of software applications in communication with various devices and equipment that support these functions of the present invention. A source/dectector unit collects data during the production process. The data is transmitted, manipulated, analyzed, and compared for conformance to tolerances and error signal output is transmitted to a process control system used to control the production process. If the sheet product is outside a specified tolerance range, an operator may also be notified so that corrective actions can be taken. Software applications may be used by an operator to perform setup and configuration operations.

34 Claims, 19 Drawing Sheets

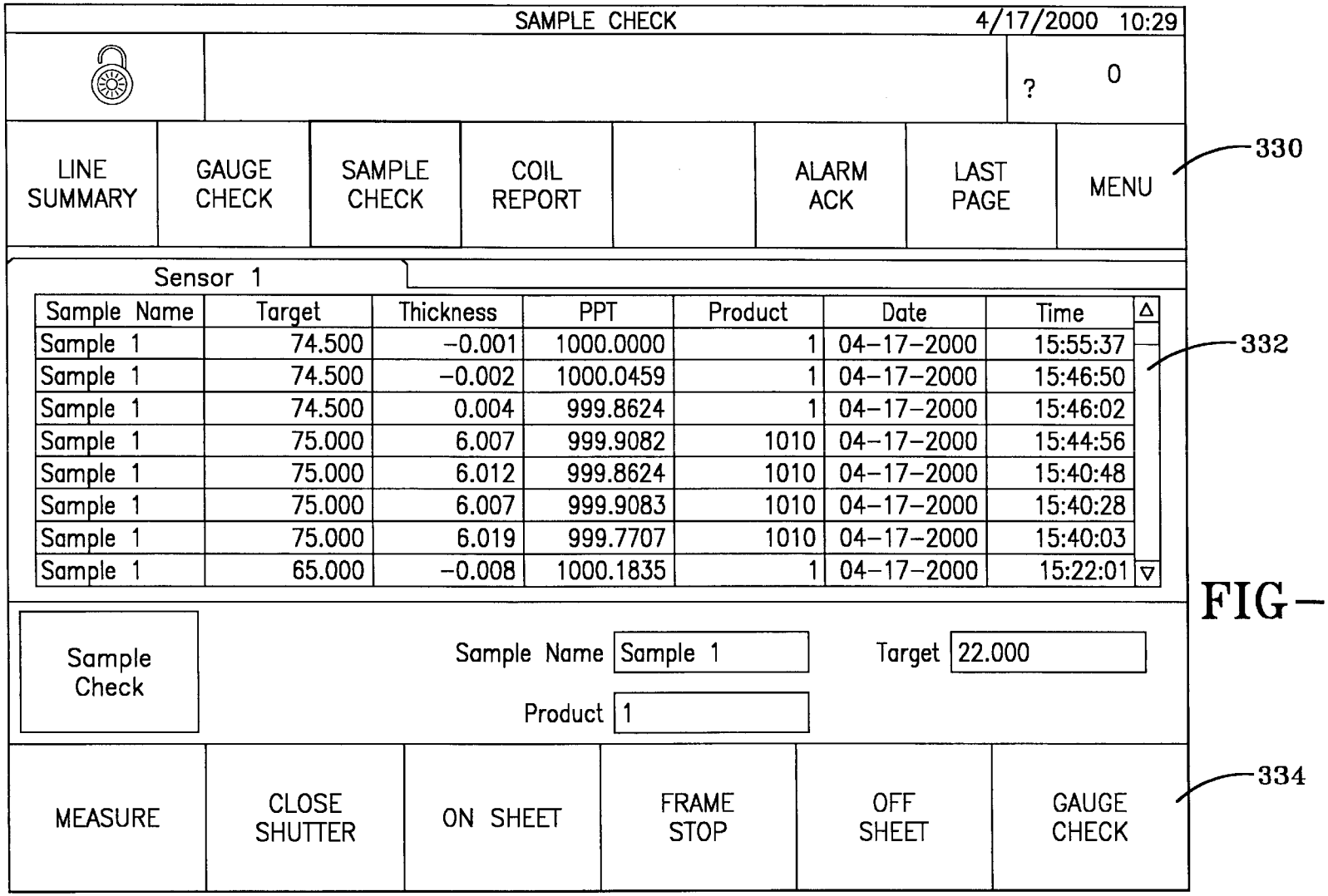
FIG−17

THICKNESS MEASUREMENT SYSTEM AND METHOD

TECHNICAL FIELD

The present invention relates to systems and methods for measuring the thickness of flat sheet products. More particularly, the present invention relates to a system and method for frequent and accurate measuring of flat sheet thickness on a process line to control the sheet production process. The system and method of the present invention comprise software applications for collecting and analyzing measurement data and providing the results to a process control system that controls the production process.

BACKGROUND AND SUMMARY OF THE INVENTION

Flat sheet products such as steel and aluminum are generally produced by a rolling process. Plastic sheet products may be produced using an extrusion or molding process. Regardless of the material, the resulting flat sheet product is typically much longer and wider than it is thick. Purchasers of flat sheet products such as metal and plastic sheets must be assured that the product meets various quality specifications and standards. In most instances, it is important that the thickness of a flat sheet product be within a very narrow tolerance across the length and width. Automated systems and methods for measuring and monitoring thickness during a mill or rolling process have been developed. However, the systems and methods that are used currently support limited sampling and testing during the production process. As a result, a product that does not meet specified tolerances and standards may be produced without the manufacturer's knowledge.

In some cases, sampling does not occur frequently enough to detect non-conformances. At the time the samples are taken, the thickness appears to be uniform and consistent because it is within specified tolerances or standards. The non-conformances may occur between samples such that the measuring and monitoring processes do not detect the problems. Even if a system and method support frequent sampling of data related to the production process, the system or method may not be able to determine quickly enough the extent of the non-conformance so that the production process may be controlled appropriately. Thickness values are typically approximated based on data in a lookup table and therefore, are not precise. The inability to determine quickly and accurately the differences between the actual and target measurements for the sheet product thickness may result in excessive scrap, wasted production time, and possibly, rejection of the final product by the customer. Therefore, there is a need in the flat sheet production process to accurately and quickly measure the thickness of the sheet and to provide an output to a process control system to the control the thickness of the sheet during the production process.

The present invention is a system and method that supports frequent and accurate measuring of flat sheet thickness on a process line to control the flat sheet production process. Results of the monitoring process of the present invention may be communicated to a process control system used to adjust the production process. Data collection and data analysis are accomplished using a plurality of software applications in communication with various devices and equipment that support the collection and analysis functions of the present invention.

The present invention may be implemented with industry standard hardware, software, and a personal computer integrated with custom software. The present invention comprises a source/detector unit, frame, or other production device for collecting data during the production process. The data is transmitted to a calculation device, such as a data acquisition processor (DAP) board, for processing. In an example embodiment of the present invention in which a DAP board is used, the measured data is manipulated, analyzed, and compared for conformance to certain specifications or tolerances. In the event the thickness of the sheet product is outside the specifications or tolerances, several actions may be taken. First, an alarm may be triggered to notify an operator or quality control specialist that the sheet thickness values are outside a specified tolerance. Data related to the calculated thickness values may be recorded. Error signal outputs may be communicated to a process control system to allow corrective actions to be taken. Additional commands may be communicated to various pieces of equipment or specific devices on the production floor. Production data may further be communicated to another production floor computer for further analysis and long-term storage. Software applications executing at the production floor computer may be used by an operator to perform setup and configuration operations for various pieces of production equipment and devices that comprise the present invention as well as to control the production process when the production equipment and devices are operational. An interactive graphical display facilitates an operator's interaction with the various software applications. The software applications support automation of the production process so that the resulting flat sheet is more likely to conform to the applicable specifications or tolerances. The system is configurable for different processing environments and flat sheet compositions.

BRIEF DESCRIPTION OF THE DRAWINGS

FIGS. 4–17 are screens of the interactive graphical interface for an example embodiment of the present invention.

DESCRIPTION OF EXAMPLE EMBODIMENTS

Figure 1:
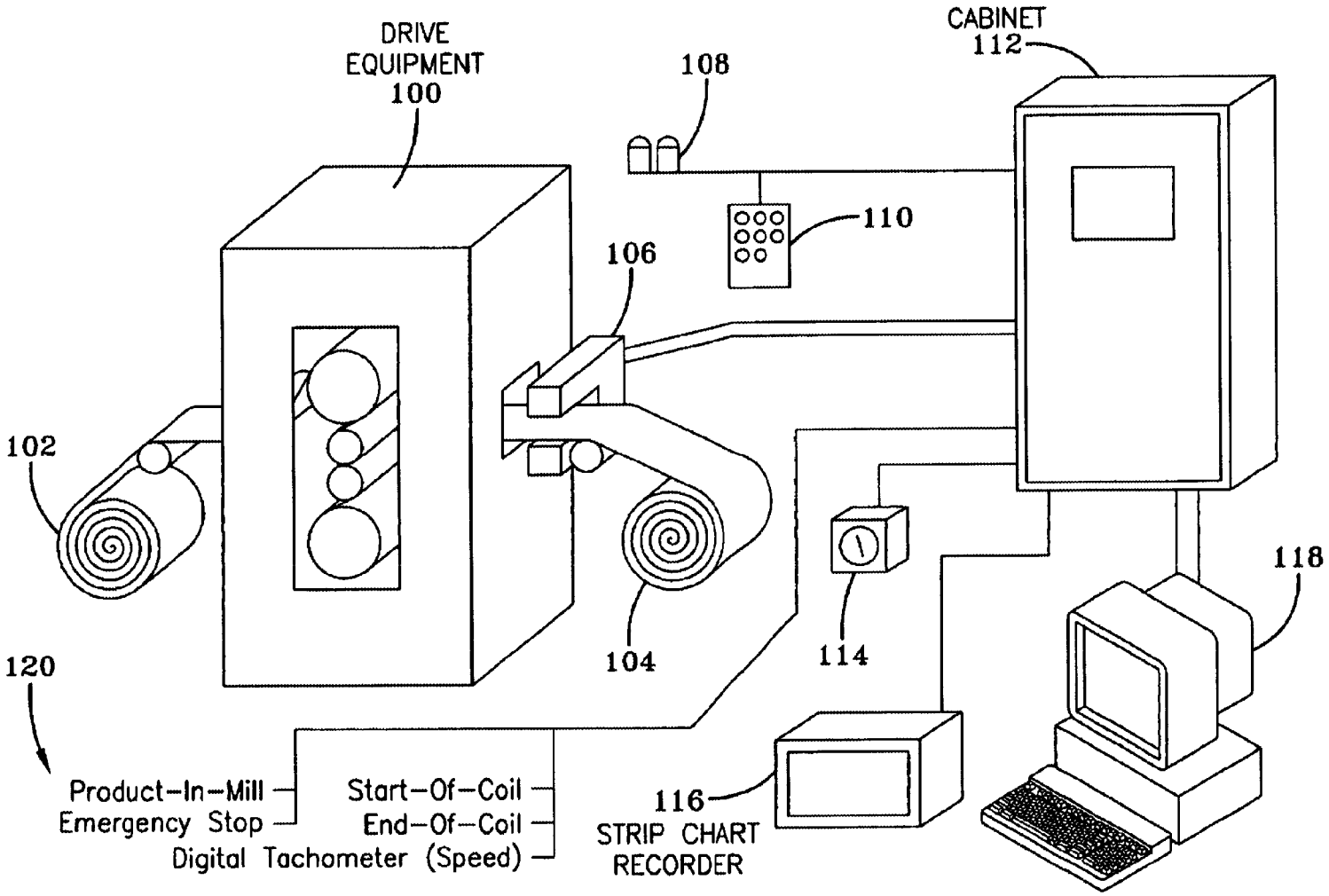
FIG. 1 is a schematic diagram of the primary components of the system for an example embodiment of the present invention.

Referring to FIG. 1, a schematic diagram of the primary components of the system for an example embodiment of the present invention is shown. An unprocessed coil 102 is processed through a mill or process line drive equipment 100 to produce a flat sheet coil 104 of a product such as aluminum, steel, or another type of metal. Other types of mills or process lines may be used to produce flat sheets of other materials such as plastic. The processed coil or flat sheet 104 is passed through a source/detector unit or frame sensor unit 106. The source/detector unit is a mechanical device that houses measurement sensors and positions the sensors on the passing flat sheet product 104. Each sensor comprises a source and detector for the data collection process. Various types of sensors such as radioisotope, x-ray, infrared, or microwave sensors may be used with the present invention. Any combination of source and detector that is capable of providing data for the present invention may be used. The source/detector unit 106 may be housed in a C-shaped frame as shown in FIG. 1. Other types of frames (e.g., frames with stationary sensors or traversing frames) may be used as well.

Shutter signal lights 108 are located in the area of the source/detector unit 106. The shutter signal lights 108 indicate whether the shutter of the source/detector unit is open or closed. Status information regarding the shutter state is important to operators because in most cases, the shutter emits radiation when it is open. A frame control unit 110 has controls for moving the sensors in the source/detector unit 106 and for performing a sample check and a gauge check. The controls of the frame control unit 110 are functional equivalents of soft controls accessible through a graphical user interface that is operational at a computer in the cabinet 112.

In accordance with the various possible configurations of sensors and frames, data from a sensor in the source/detector unit 106 is transmitted through an analog-to-digital converter (ADC) on a data acquisition processor (DAP) board that is housed in the computer inside the cabinet 112. The cabinet 112 houses the computer as well as other interface hardware that brings measurement and process signals into the computer and output signals from the computer to an operator display unit and control actuators in the source/detector unit 106. An electrical signal from the sensor's source/detector unit 106, after being amplified by an electrometer, is transferred to the ADC on the DAP board on the computer in the cabinet 112. The electrical signal is processed by various hardware and software components at the cabinet 112 to calculate thickness values for the processed coil 104.

A plurality of signals 120 in the form of contact closures are provided by the mill or process line drive equipment as safety interlocks for the source/detector unit 106 or as production information for displays or reports. The product-in-mill (PIM) signal indicates that the process sheet is threaded through the air gap of the measurement sensor. The emergency stop signal indicates that the mill or process line is in an emergency stop condition. The tachometer or speed signal is an analog signal representing the mill or process line speed. This information may be used to calculate a processed coil length. The start-of-coil and end-of-coil signals represent, respectively, the start and end of a coil and may be used in producing a coil report.

An optional deviation meter 114, which may be considered a production device, is an analog or digital device that displays the calculated thickness as a deviation from a target thickness for the flat sheet product. An optional strip chart recorder 116, which may be considered a production device, provides a hard copy record of the calculated thickness for the flat sheet product. Signals to the deviation meter 114 and strip chart recorder 116 are processed through a digital-to-analog converter (DAC) on the DAP board of the computer housed in the cabinet 112. Finally, an optional host computer 118 may be used to send product specification information to and collect processing data from the hardware/software components of the cabinet 112. The host computer may also be used to send control signals to the source/detector unit 106.

Figure 2:
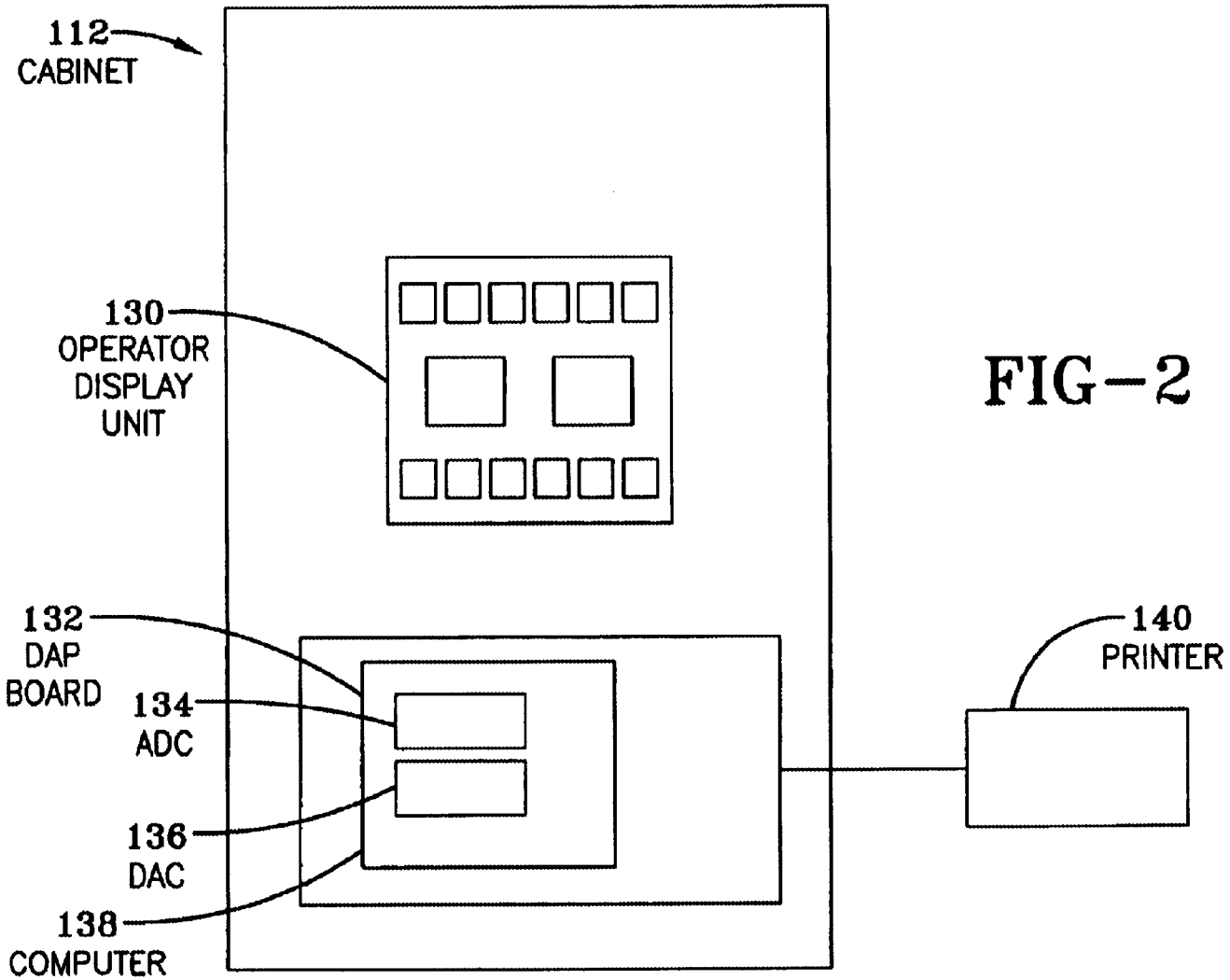
FIG. 2 is a schematic diagram of the primary measurement components of the system for an example embodiment of the present invention.

Referring to FIG. 2, a schematic diagram of the primary measurement components of a system in accordance with an example embodiment of the present invention is shown. The cabinet 112 houses an operator display unit 130 comprising a touch screen for interacting with a computer 138, and an ADC 134 and a DAC 136 on a DAP board 132, and other production equipment and devices. Finally, a printer 140 attached to the computer 138 may be used to print production reports and other information. The computer may be an industry standard personal computer equipped with the Microsoft Windows operating system. In addition to a DAP board 132, other computing devices such as a microcontroller may be used to provide the features and functionality of the calculation device of the present invention. Any device that is adapted for processing of measurement data and calculating of thickness values may be used.

Electrical signals from the sensors in the source/detector unit are transferred through the ADC 134 for processing at the DAP board 132. The analog electrical signals from the sensor are digitized by the ADC 134 for processing at the DAP board 132. In an example embodiment of the present invention, all A/D and D/A signals use 16-bit processing for maximum resolution. The DAP board 132 performs various data collection and analysis functions in order to calculate thickness values for the flat sheet passing through the source/detector unit. Data samples are collected every 100 microseconds. Error signal output based on the calculated thickness values may be transmitted through the DAC 136 of the DAP board 132 to a process control system for the mill (or other related production device). The process control system causes roll pressure to increase or decrease based on the error signal output. The error signal output may represent actual error values based on the difference between the calculated thickness and a target thickness. The error signal output may represent average error values based on differences between calculated thickness values and a target thickness value. The error signal output may also represent an exponentially filtered error value based on calculated thickness values and a target thickness value. Different error signal output may be provided based on the requirements of the process control system for the mill or process line equipment. As indicated previously, the error output signal transmitted to the process control system may be processed through a DAC if analog data is required by the process control system.

The computer 138 comprises a plurality of software applications or modules to provide the features and functionality of the present invention. In an example embodiment of the present invention, the software applications are written in Visual Basic and communications between the various software applications are accomplished in accordance with Active X controls. Software applications are used to control the DAP board 132 which in turn controls the source/detector unit. Human interaction with the various software applications is accomplished through the operator display unit 130 which comprises a touch screen interface. The screens of the software applications or modules are designed for ease of use and to provide a consistent interaction model for operators of the various software applications. Various portions of the screen are dedicated to certain operations or functions regardless of the software application that is currently executing.

Figure 3A:
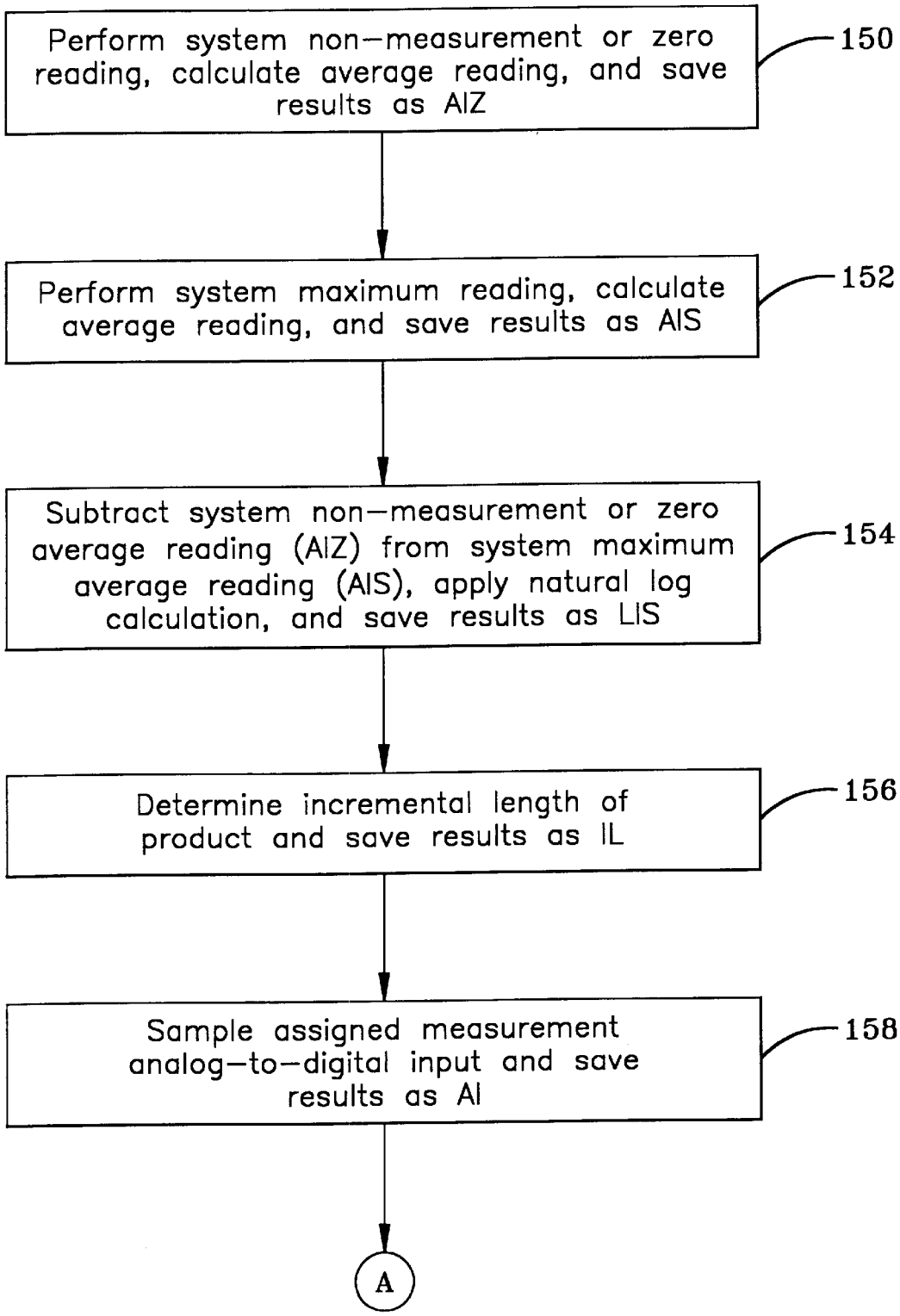
FIGS. 3A–3C are a flow diagram of the primary steps for the method of measuring thickness for an example embodiment of the present invention.
Figure 3B:
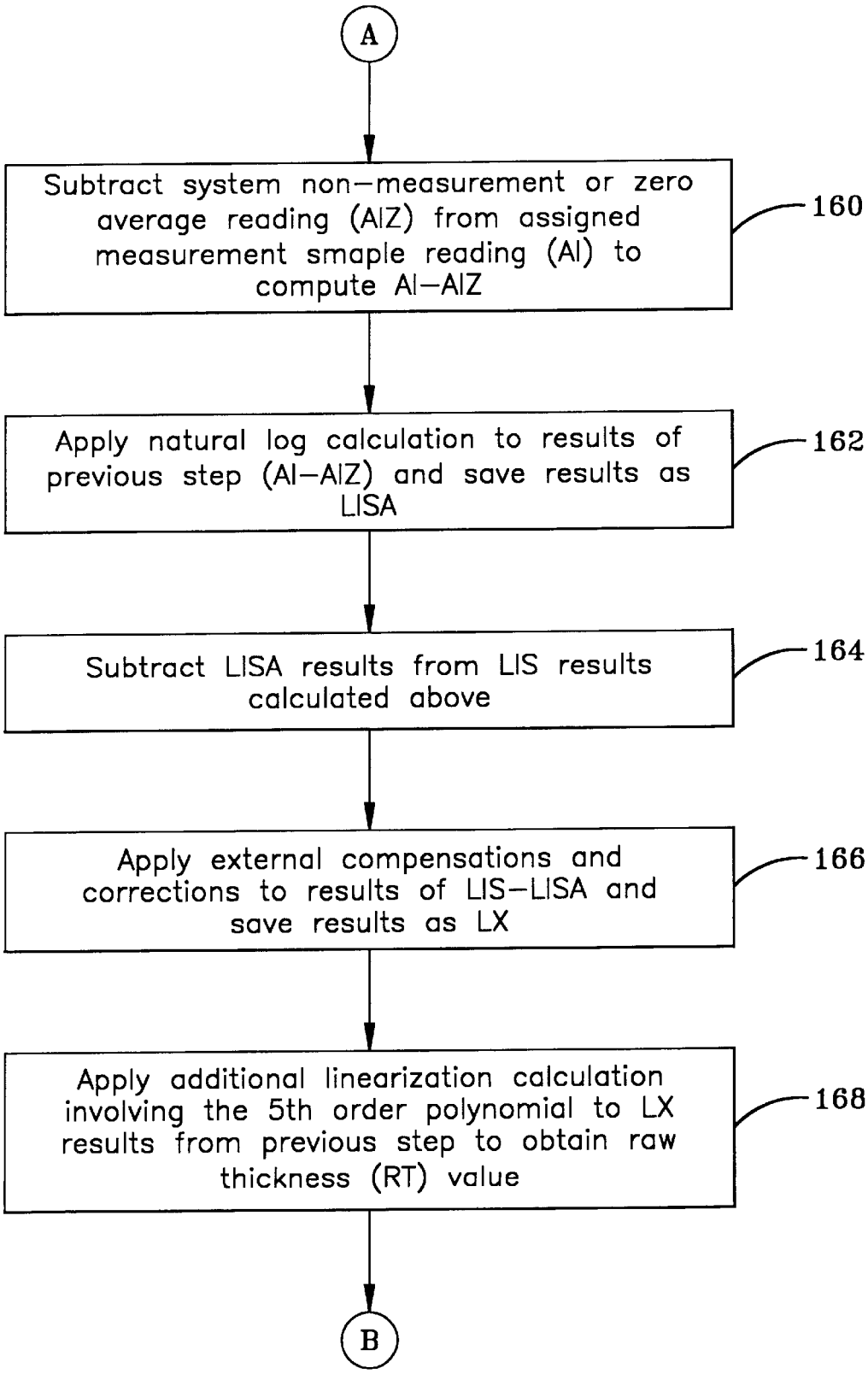
Figure 3C:
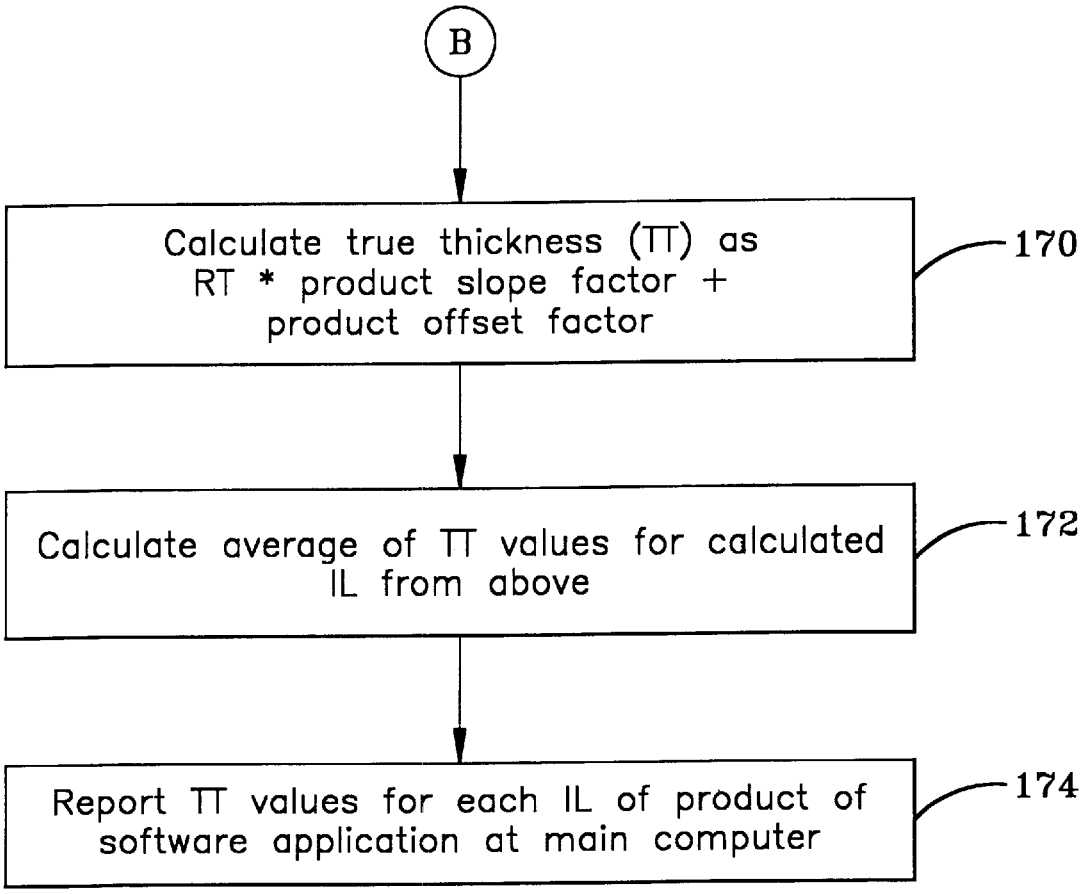

Referring to FIGS. 3A–3C, a flow diagram of the primary steps for the method of calculating thickness for an example embodiment of the present invention is shown. Thickness values are calculated by a software application operational at the DAP board. Because the DAP board is dedicated to calculating thicknesses based on sensor measurement data, thickness values are determined virtually in real time. Other devices may be used to calculate thickness values in real time. The sensor measurement data is input to a thickness calculation procedure performed by the DAP board. As a result, accurate thickness data may be recorded and reported throughout a processing run to detect problems as they occur.

A thickness value for a specified incremental length of a flat sheet product such as metal or plastic is calculated as follows. Initially, a gauge check procedure is completed by an operator when measurement is not in progress. The gauge check procedure comprises the first three steps of the method. Referring to FIG. 3A, in step 150, a system non-measurement or zero reading with the measurement sensor shutter closed is determined by sampling the assigned measurement analog-to-digital input at a specified rate (e.g., 10K Hz). An average reading is calculated based on an average value for a period of time (e.g., five (5) seconds). The results are saved as AIZ.

Next, in step 152, a system maximum reading with the measurement sensor shutter open and nothing in the sensor is determined by sampling the analog-to-digital input at a specified rate (e.g., 10K Hz). An average reading is calculated based on an average value for a period of time (e.g., five (5) seconds). The results are saved as AIS.

Next, in step 154, a linearization calculation is performed by taking the natural log of the system maximum average analog-to-digital reading (AIS) minus the system non-measurement or zero average analog-to-digital reading (AIZ) and saving the results as LIS for the thickness calculation process to be performed later.

In the next steps of the method, the incremental product length is determined from a process speed input. From the assigned speed analog-to-digital input, the process speed, in length per minute, is known and the determination of incremental length can be calculated.

In the remaining steps of the method, the thickness of the product is determined by calculating thickness values based on sensor measurement data. From a process input indicating that the product is present for measurement, the system automatically, via a programming control or by a manual request through the touch screen, enables the measurement process. At a selected frequency (e.g., 10K Hz or less), the assigned measurement analog-to-digital input from the sensors of the source/detector unit is sampled and saved as AI in step 158. Referring to FIG. 3B, the system non-measurement or zero average reading (AIZ) is subtracted from the assigned measurement sample reading (AI) to compute AI−AIZ, step 160.

In step 162, a natural log calculation of the results of the previous step is determined and the results are saved as LISA. The LISA results are subtracted from the linearization natural log results (LIS) calculated earlier in the gauge check process in step 164. This result, along with any external compensations and/or corrections, is saved as LX in step 166. An additional linearization calculation involving a $5^{th}$ order polynomial is applied to the LX results from previous step to obtain the raw thickness (RT) value of step 168. The equation is:

$$RT=LX/(K_0+K_1*LX+K_2*LX^2+K_3*LX^3+K_4*LX^4+K_5*LX^5) \quad (1)$$

where $K_0$, $K_1$, $K_2$, $K_3$, $K_4$, $K_5$ are head constants determined in accordance with a laboratory test. Referring to FIG. 3C, a range slope factor and range offset factor is applied to the RT results determined in the previous step to obtain true thickness (TT) values as in step 170:

$$TT=RT*\text{range slope factor}+\text{range offset factor} \quad (2)$$

In step 172, an average of the TT values is calculated for the specified incremental length IL as calculated from the product speed/length process of the method. The true thickness TT values for each incremental length IL of product are passed to the main software application at the computer for display, statistical analysis, trending, and storage into the database. Error output signals based on the TT values may be communicated to a process control system to adjust the production process.

Figure 4:
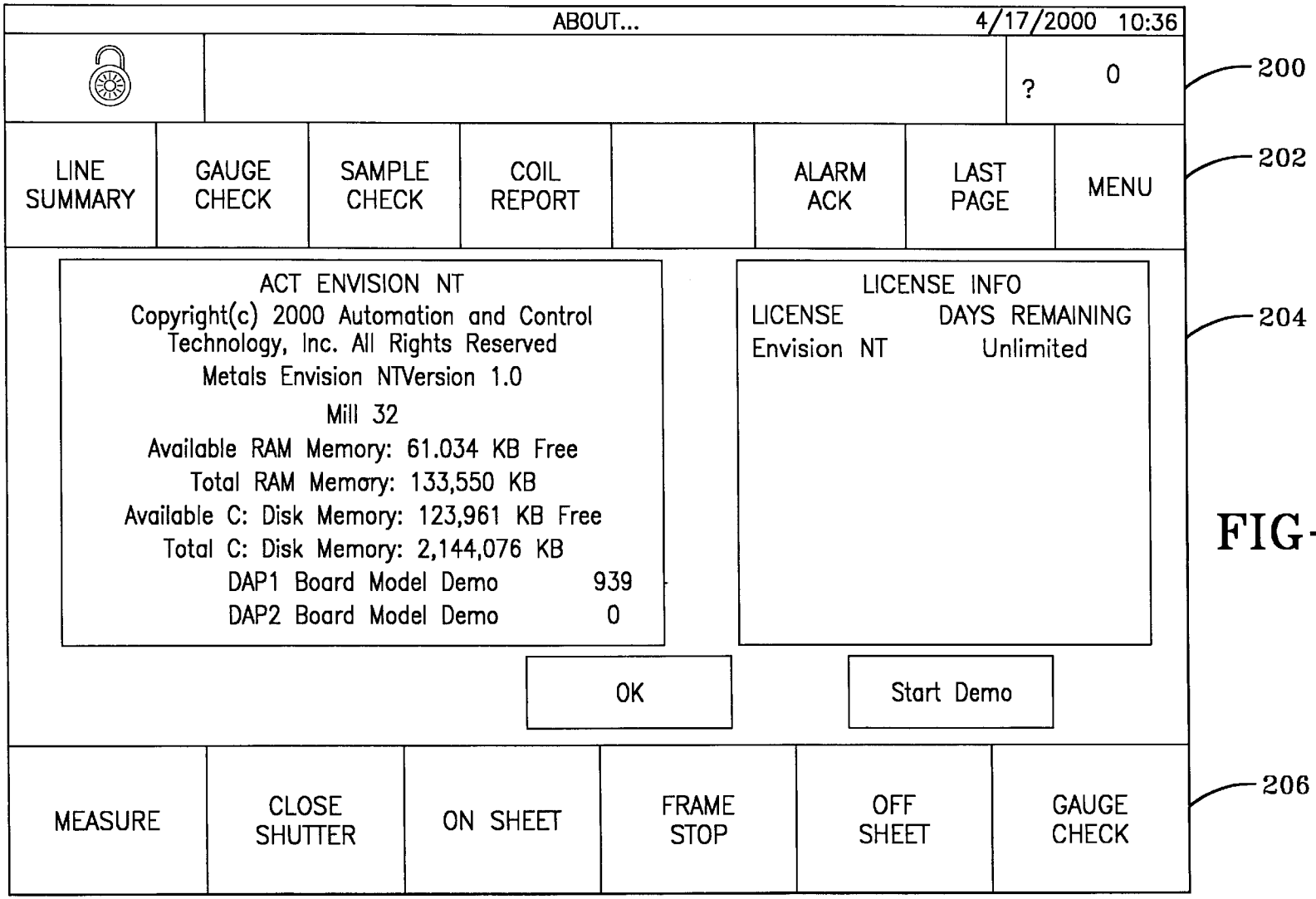

Referring to FIG. 4, a start screen in accordance with an example embodiment of the present invention is shown. The top row of the screen 200 is reserved for communicating to an operator alarm information and other status information. The next row of the screen 202 is reserved for various software applications or modules with which a user may interact. The LINE SUMMARY, GAUGE CHECK, SAMPLE CHECK, and COIL REPORT applications are explained in accordance with associated screens for each of the applications. In an example embodiment of the present invention, touch screen buttons are displayed for the software applications with which a user is most likely to interact. A user's selection of one of the touch screen buttons appearing in this row results in the invocation of an associated software application. A "MENU" button at the end of this row results in the display of a menu of additional software applications from which a user may select. The menu may be used to access software applications that are needed less frequently than the software applications with dedicated buttons.

The middle of the screen 204 is used for input to and output resulting from the currently executing software application. Depending on the application that is currently operational, additional buttons from which the user may select may be displayed in this area. Requests for additional information and the results of measuring and processing may be displayed in one or more windows in this area.

The bottom row of the screen 206 is reserved for command or action buttons. Each button on the bottom row is associated with a software application for controlling the production process. Each application may control one or more pieces of equipment or devices on the process line. For example, commands to the DAP board may be initiated from an application selected from this row. When a second frame is present on the system, the buttons are divided horizontally to create a second set of controls for the second frame. The MEASURE command opens the sensor shutter and starts the measurement process. The CLOSE SHUTTER command stops measurement and closes the sensor shutter. The ON SHEET command causes a traversing frame to more toward its ON SHEET position for measuring. The open shutter command may be automatically initiated when the frame reaches the ON SHEET position. Alternatively, a separate action of the OPEN SHUTTER button may be required to begin measurement. The FRAME STOP command causes a traversing frame to stop traversing at any point between the ON SHEET and OFF SHEET position. As a result, measurement may be performed at a position other than the full ON SHEET position. It may also be used as an emergency stop to prevent the frame from going fully ON SHEET or OFF SHEET. An open shutter command and measurement may be automatically initiated when FRAME STOP is selected or a separate action of the shutter open may be required. The OFF SHEET command causes a traversing frame to move toward its OFF SHEET position. The sensor CLOSE SHUTTER function is automatically initiated when the OFF SHEET is selected or when an emergency stop signal occurs. The GAUGE CHECK command initiates a gauge check procedure.

Figure 5:
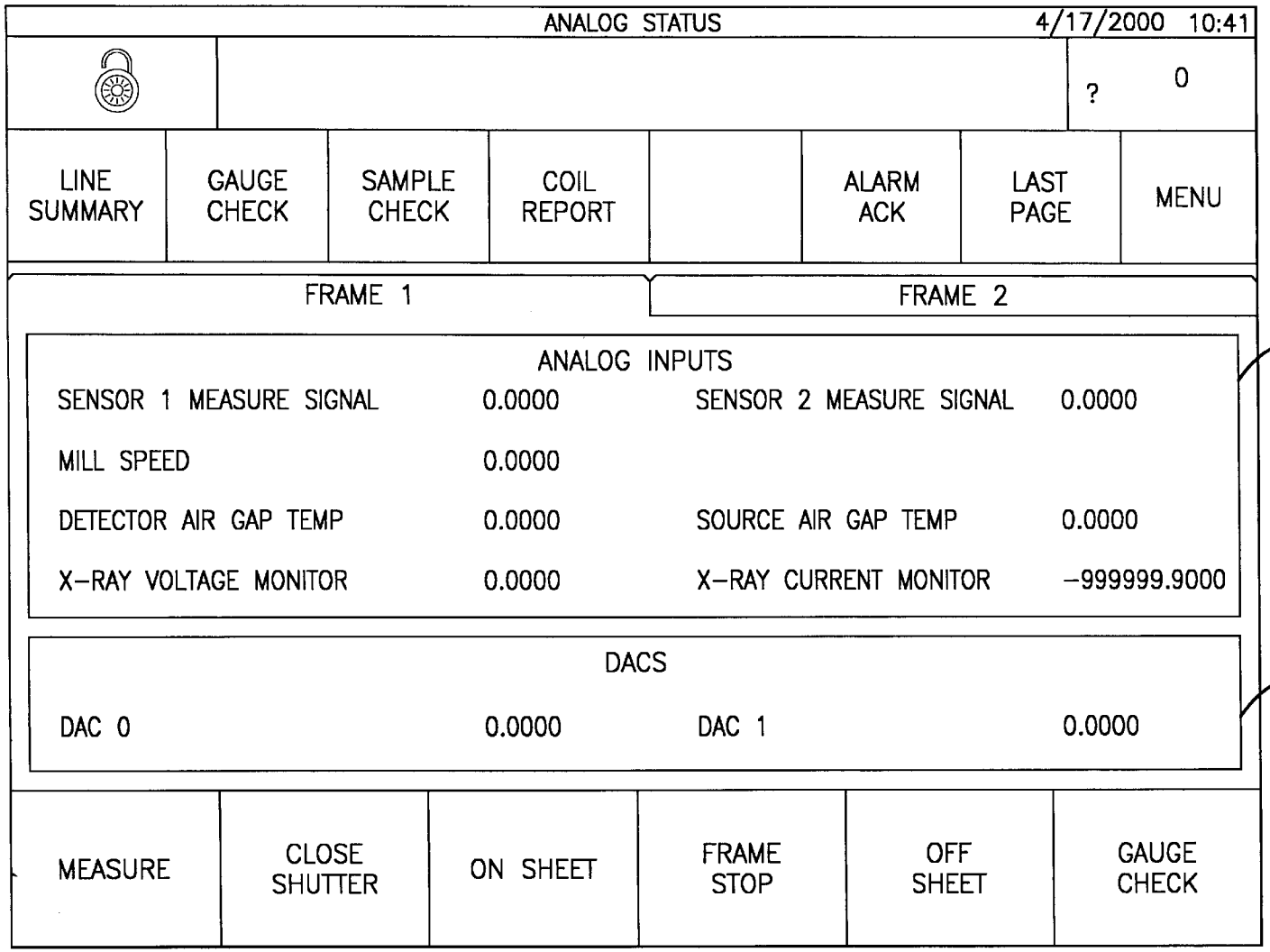

Referring to FIG. 5, an analog status screen for an example embodiment of the present invention is shown. The analog status screen displays the incoming and outgoing analog signals for the computer and the mill or process line equipment 210. The analog input signals that are displayed include the electrometer signal which is the thickness measurement signal from the sensor of the source/detector unit, the mill speed, the x-ray sensor detector air gap temperature, and the x-ray voltage monitor if x-ray sensors are used. If more than one sensor is present in a frame, data for each sensor is displayed. If more than one frame is used on the process line, data for the additional frames may be viewed by selecting a tab for the frame. Also displayed on the screen with the analog inputs are the DAC output signals 212 which are used by the mill process control system, chart recorder, deviation meter, or other production device.

Figure 6:
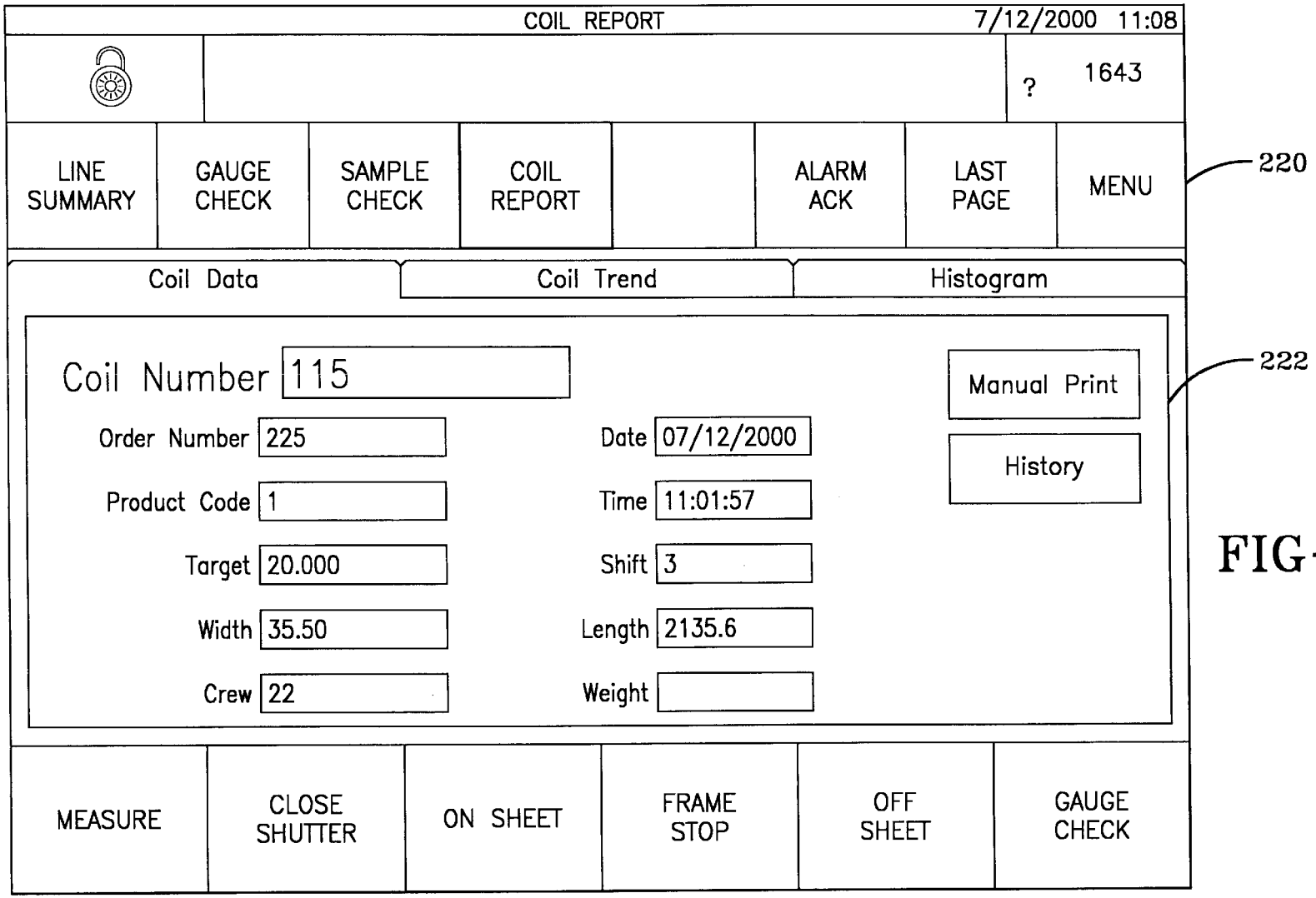

Referring to FIG. 6, a coil report screen for an example embodiment of the present invention is shown. The coil report screen may be accessed by selecting the coil report application button at the top of the screen 220. The coil report screen displays information related to the coil or product currently under processing 222. In addition, coil reports for previously processed coils may be reviewed. The coil data portion of the coil report provides identifying information for the coil. Included in the coil data is the target thickness value for the processing run. This target value is used during processing to determine if the processed coil or product is within a specified range or tolerance (e.g., upper and lower bounds for thickness). Similar data may be provided for flat sheet products that are not processed as coils such as certain types of plastics or metals.

Figure 7:
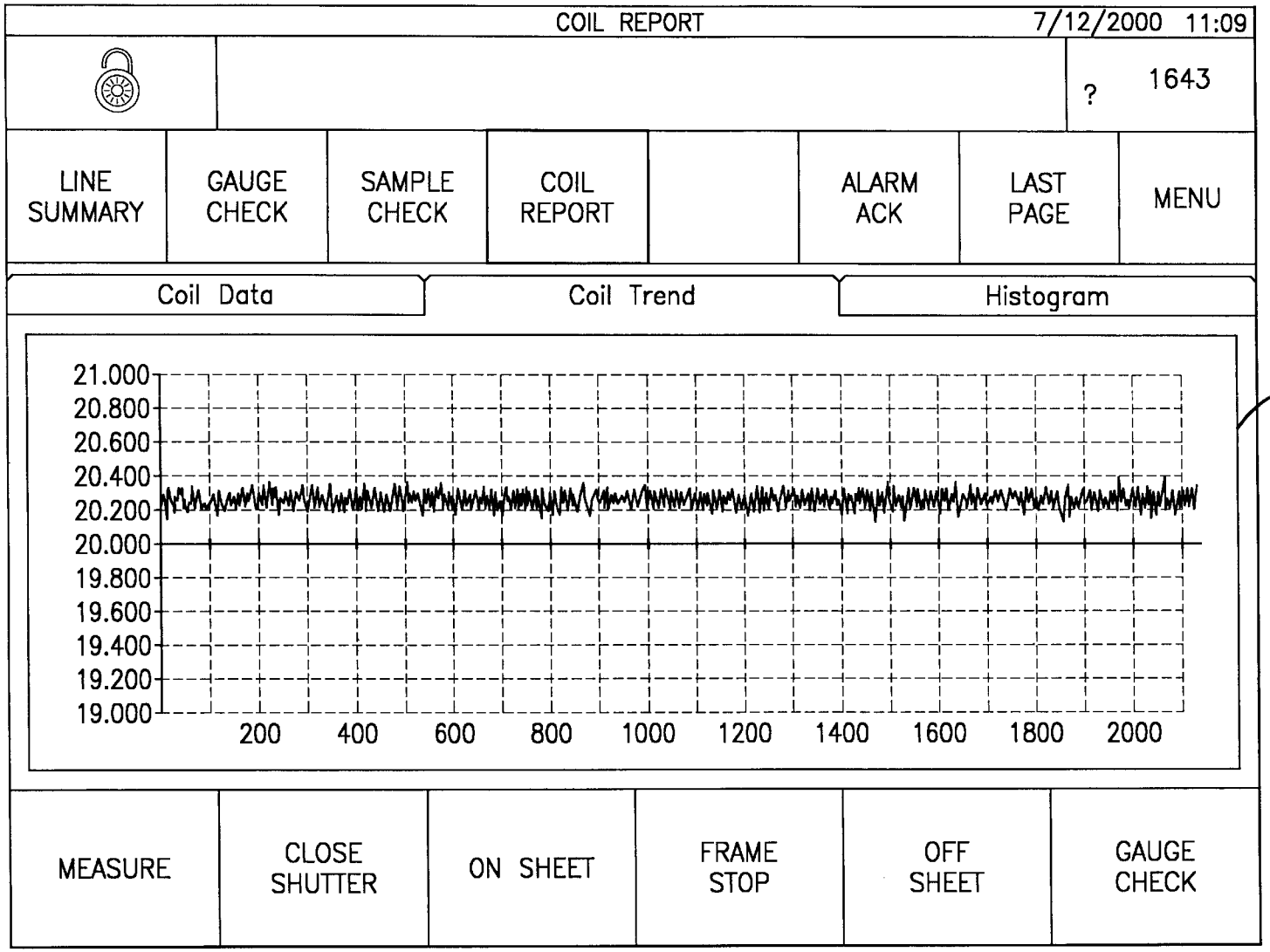

Referring to FIG. 7, a coil trend screen in accordance with an example embodiment of the present invention is shown. Values along the left side of the mid-portion of the screen 230 (or on a vertical axis) represent thickness values. Values along the bottom of the mid-portion of the screen 230 (or horizontal axis) related to positions along the processed sheet. Indicators (e.g., points or lines) that represent the calculated thickness values are shown in conjunction with the target thickness to provide a visual indication of the thickness of the processed flat sheet in relation to the target thickness 230 for a plurality of positions along the processed sheet. For the coil shown in FIG. 7, the calculated thickness of the processed coil is slightly higher than the target thickness of 20. Thickness values for positions along the processed coil are calculated in accordance with the process described in FIGS. 3A–3C. In the event the system reports calculated thickness values that exceed threshold values for the target thickness value (e.g., an upper and lower limit), an operator may be notified (e.g., by displaying an error message or sounding an alarm) so that corrective actions may be taken. An error output signal communicated to a process control system allows the production process to be tuned appropriately.

Figure 8:
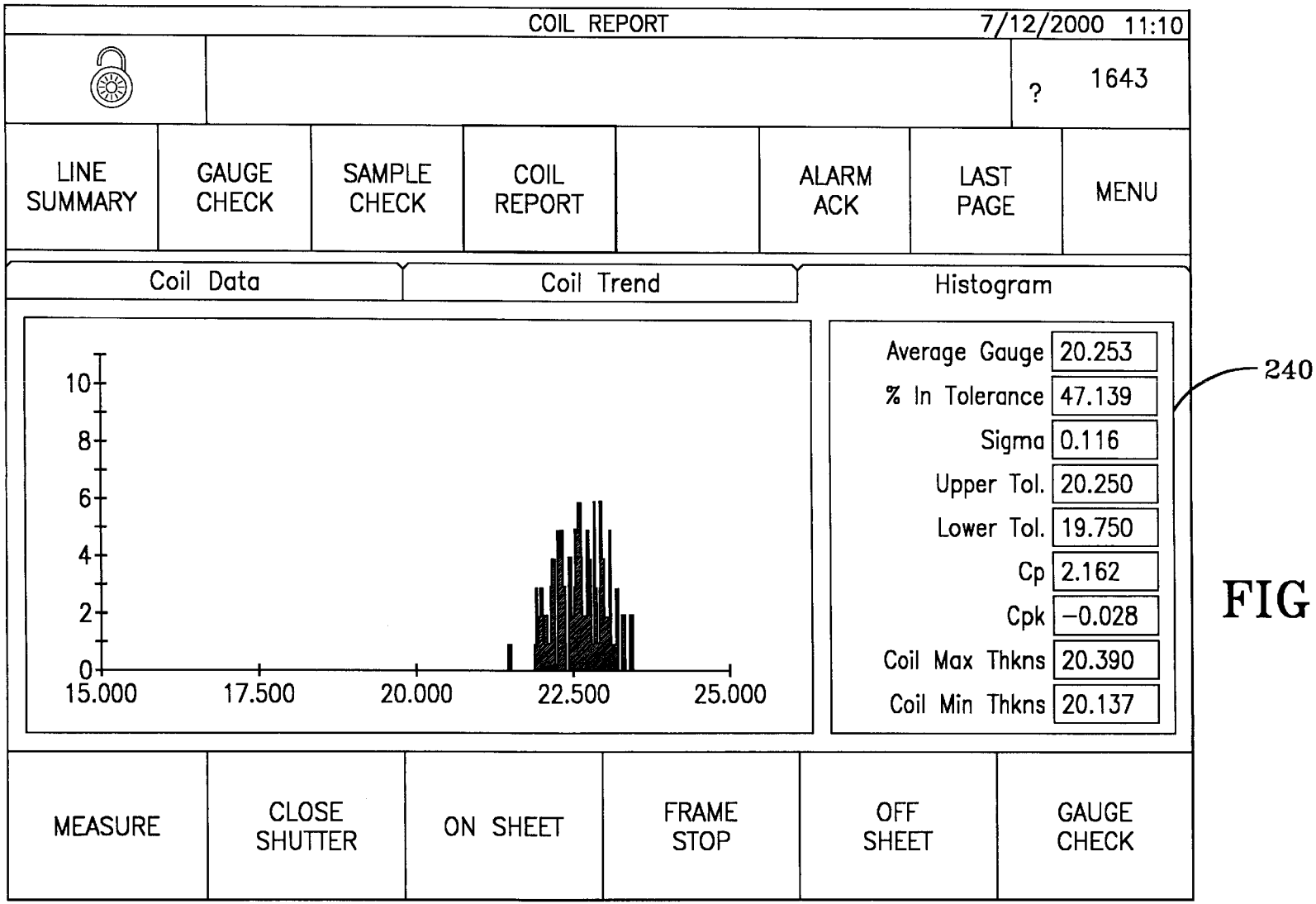

Referring to FIG. 8, a coil histogram for an example embodiment of the present invention is shown. In addition to displaying a histogram for the calculated thickness data, the average thickness as well as minimum and maximum thicknesses are shown 240. Upper and lower limits are shown as well as other statistics regarding the calculated thicknesses to provide a complete report of the processing run results.

Figure 9:
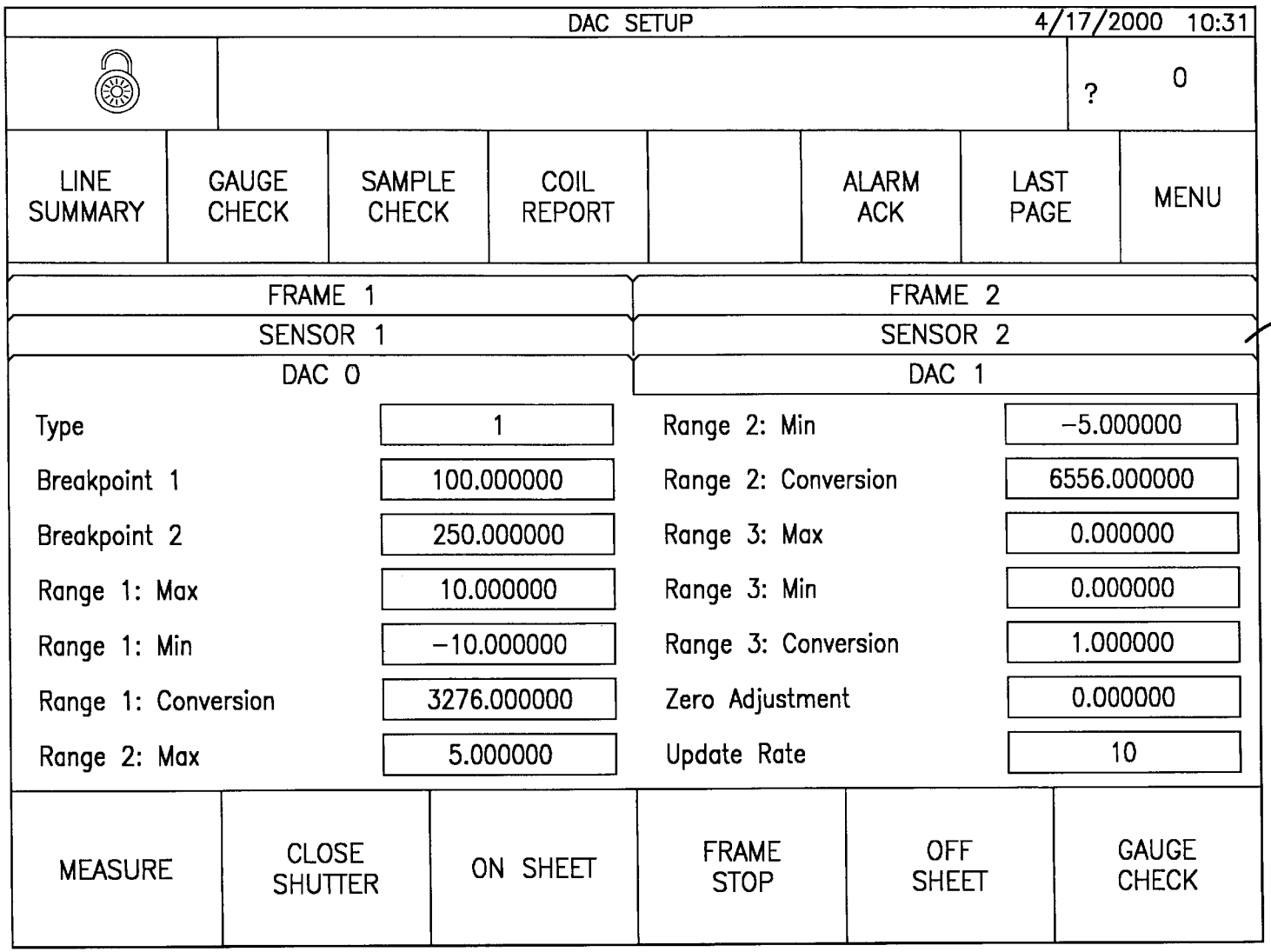

Referring to FIG. 9, a DAC setup screen for an example embodiment of the present invention is shown. A DAC may be used for communication with other analog devices in the system such as a process control system for controlling the production process, a deviation meter, or a strip chart recorder. Various data values for use with one or more DACs may be entered and edited through this screen.

Figure 10:
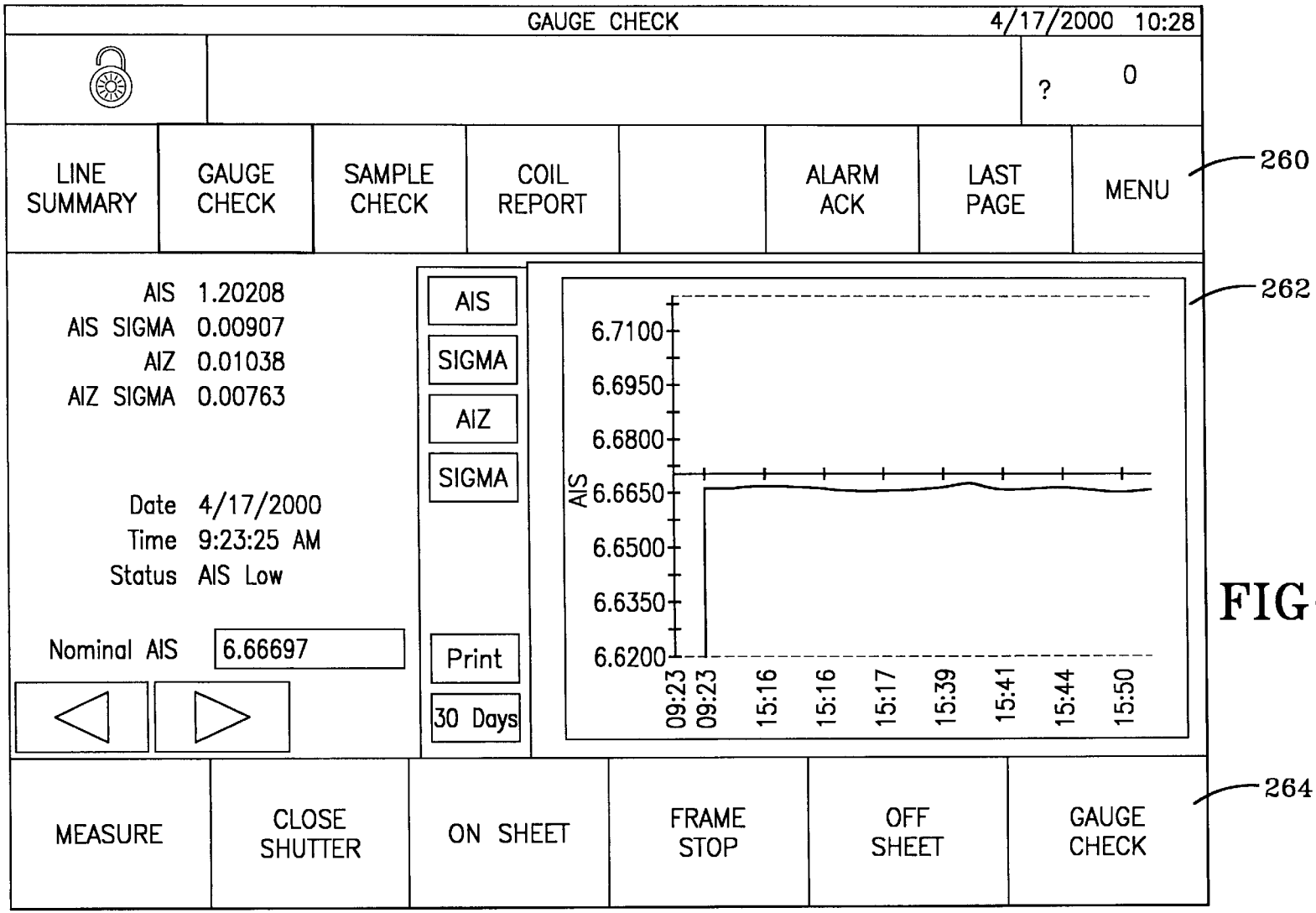

Referring to FIG. 10, a gauge check screen for an example embodiment of the present invention is shown. Selecting the gauge check button 264 at the bottom of the screen initiates a gauge check of a sensor located in a source/detector unit. A gauge check is a self-diagnostic procedure that is performed periodically to ensure that the sensors of the source/detector unit are operating properly. A gauge check compensates the sensor measurement signal for loss of radiation intensity (source decay) which may occur over time due to build-up of oil and dirt on the sensor's windows. A gauge check may be performed during processing when a sensor goes OFF SHEET or a check may be initiated upon request. As explained previously, during a gauge check, sensor output signals at "zero" (no radiation) and "source" (full radiation) are compared to known limits. If the sensor signal is outside these limits, an alarm is issued to alert an operator. If no error messages are displayed or no alarms are sounded after the gauge check procedure is performed, the system may be used to obtain measurement data and to calculate thickness values based on the measurement data.

Selecting the gauge check button 260 at the top of the screen initiates a display of the results of a gauge check. The gauge check results appear in the middle of the screen. The gauge check results comprise four data values. The Analog Input–Source (AIS) value is the digital value of the sensor's analog signal received at the DAP board during a source (full radiation) gauge check. This maximum value represents a zero thickness such that none of the source's energy is blocked by any material other than air. The AIS Sigma value is the standard deviation calculated during the period of measurement for the AIS value. The Analog Input–Zero (AIZ) value is the digital value of the sensor's analog signal received at the DAP board during a zero (no radiation) gauge check. This minimum value represents an infinite thickness such that the sensor's shutter blocks the energy source completely. The AIZ Sigma value is the standard deviation calculated during the period of measurement for the AIZ value. The date and time of the check is noted on the screen as well as a status indicating the results of the gauge check. Any status other than PASSED indicates the sensor's air gap may need to be cleared of some material or cleaned. Alternatively, the system may need to be serviced. Also displayed on the screen is a graph which shows data values for a selected value. For example, selection of the AIS button to the left of the graph results in the display of AIS data.

Figure 11:
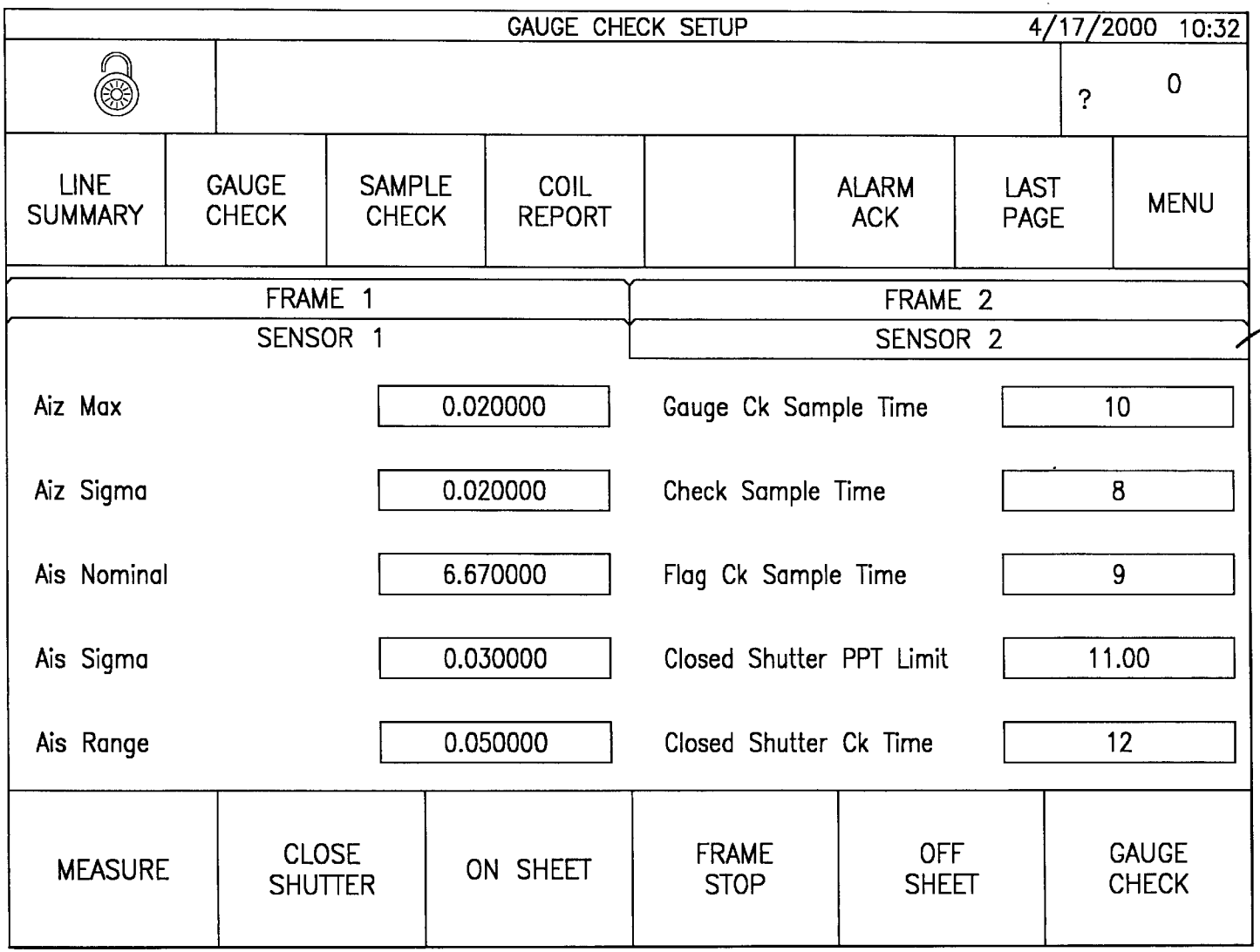

Referring to FIG. 11, a gauge check setup screen for an example embodiment of the present invention is shown. The gauge check setup screen allows an operator to set the various limits used by the gauge check software module to determine when the measurements are outside an acceptable operating range 270. Measurements that exceed the specified limits cause an error message to be displayed and/or an alarm to be sounded so that corrective service may be performed. The AIZ Max value is the maximum AIZ value that should be received at the DAP board during a zero gauge check. The AIZ Sigma value is the maximum acceptable standard deviation that should result during the period of measurement for the AIZ value. The AIS Nominal value is the normal value that should be received at the DAP board during a source gauge check. The AIS Sigma value is the maximum acceptable standard deviation that should result during the period of measurement for the AIS value. The AIS Range value is the maximum acceptable range for the AIS value. Other values that may be set for a gauge check include the gauge check sample time, check sample time, flag check sample time, closed shutter PPT limit, and closed shutter check time. The gauge check sample time is the total time in seconds that gauge check samples, and AIZ and AIS readings, are collected. For AIZ and AIS readings, half the time is devoted to collecting AIZ readings and half the time is devoted to collecting AIS readings. The check sample time is the time in seconds that sample check thickness readings are collected and averaged for a sample. A flag check sample time is the time in seconds that flag check thickness readings are collected and averaged for a sample. A flag check is the same as a sample check except it always uses a sample internal to an x-ray sensor. A closed shutter PPT limit is a limit in parts per thousand [calculated as (analog sensor reading AI−AIZ)*1000/(AIS−AIZ)] that if exceeded for a time in seconds for more than the "closed shutter check time," forces the shutter to close. Different values may be specified for each sensor in each source/detector unit in use.

Figure 12:
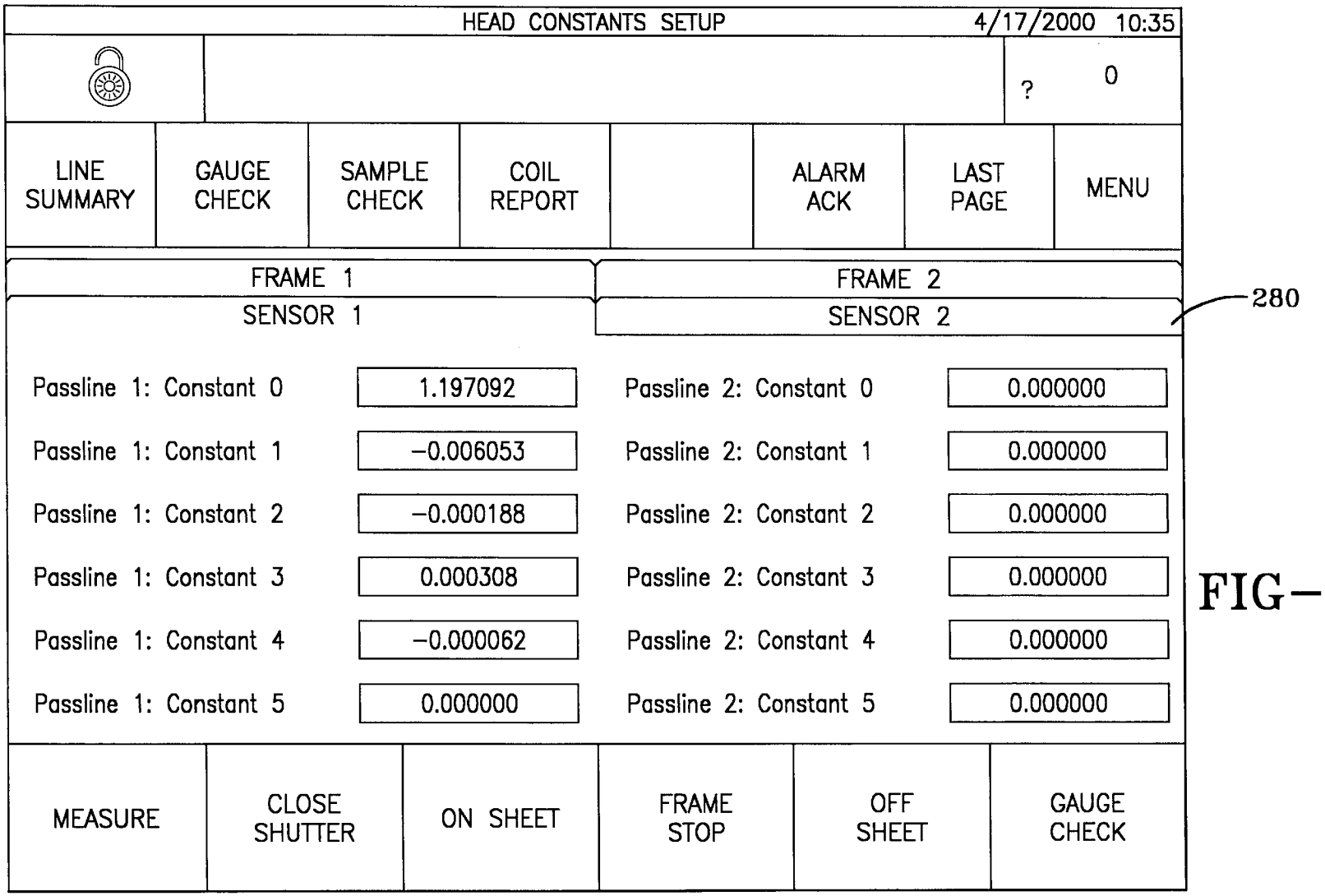

Referring to FIG. 12, a head constants setup screen for an example embodiment of the present invention is shown. The head constants setup screen allows an operator to enter characteristics for a specific sensor used in the $5^{th}$ order polynomial linearization calculation to ensure that the sensor correctly and accurately measures the material in the process line. These characteristics are in the form of head constants determined by laboratory tests. They are used during the measurement process to calculate a thickness for the material under production. The head constants are calculated using the thickness sample check procedures with standard samples of known thicknesses. Various samples over a range of thicknesses are used. A calculated thickness value for each sample is compared to the known thickness for the sample. A least squares fit algorithm is applied to the calculated thickness values to determine the head constants. In an example embodiment of the present invention in which a $5^{th}$ order polynomial is used in calculating thicknesses during the production process, six head constants are determined.

Figure 13:
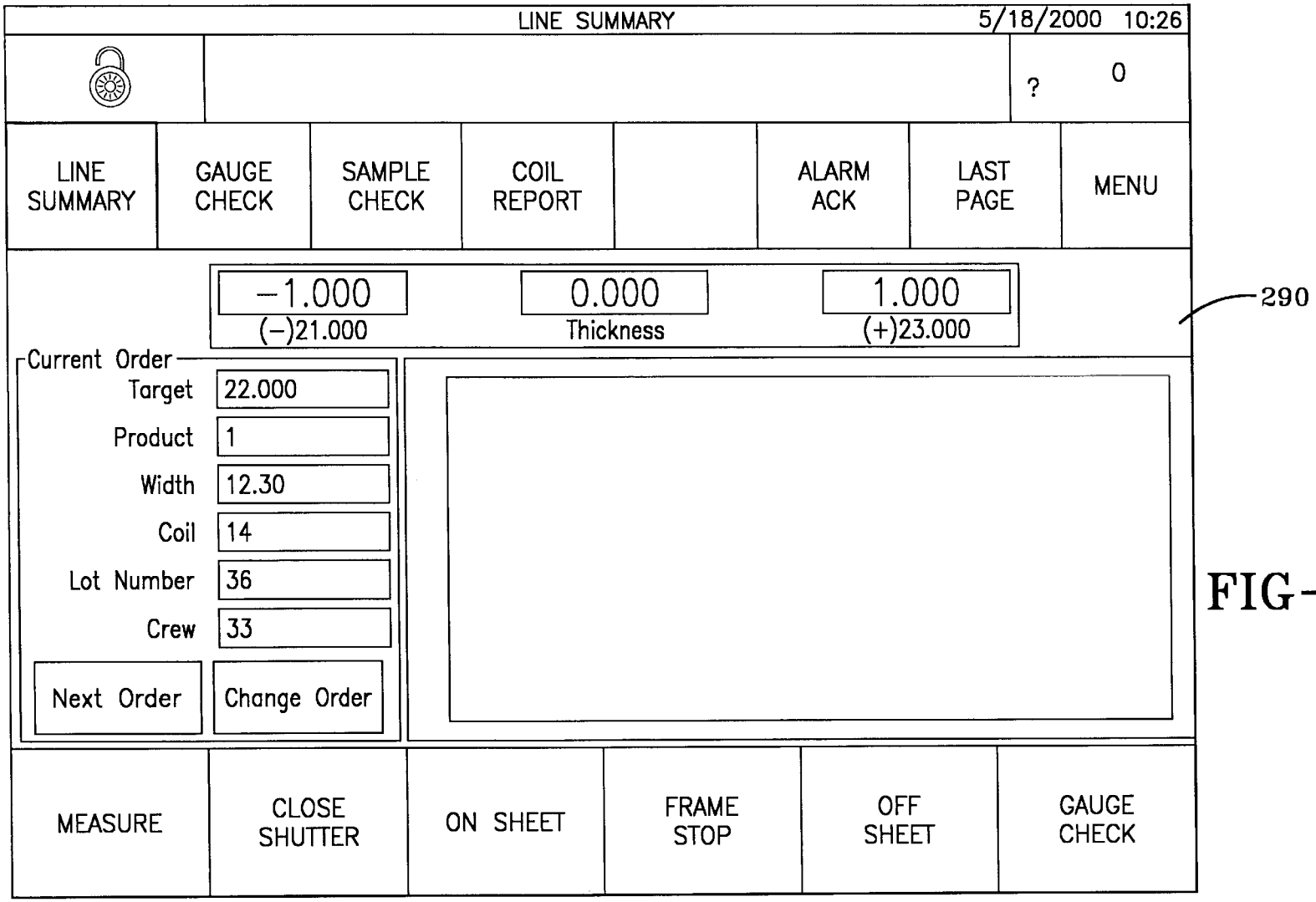

Referring to FIG. 13, a line summary screen for an example embodiment of the present invention is shown. The line summary screen displays for an operator the processing requirements for a particular product. In the middle section of the screen 290, statistics regarding the product in the mill or under processing are shown. The target thickness is shown along with specified tolerances. In the center section of the screen, a trend graph showing the thickness readings over the length of the sheet is displayed.

Figure 14:
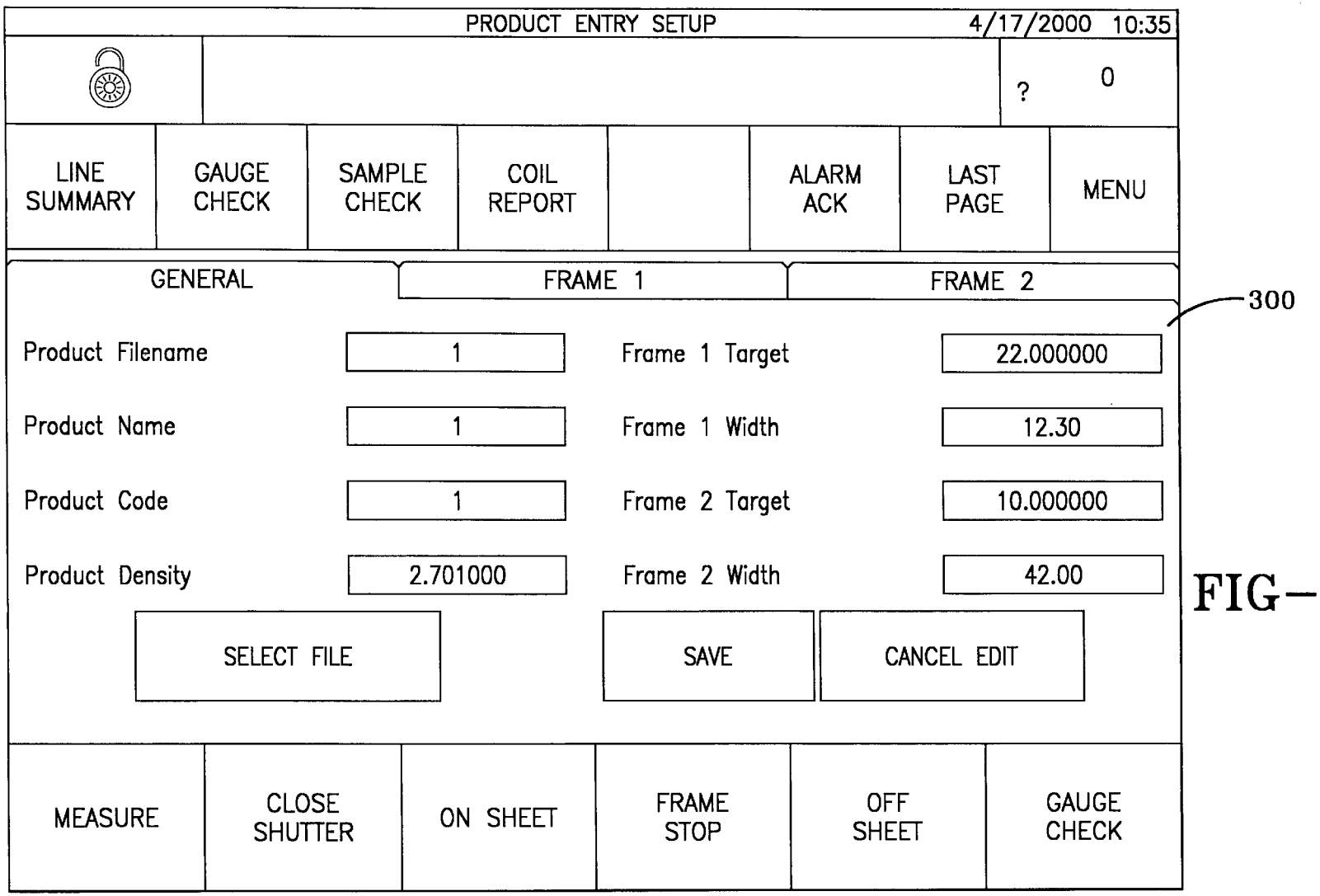
Figure 15:
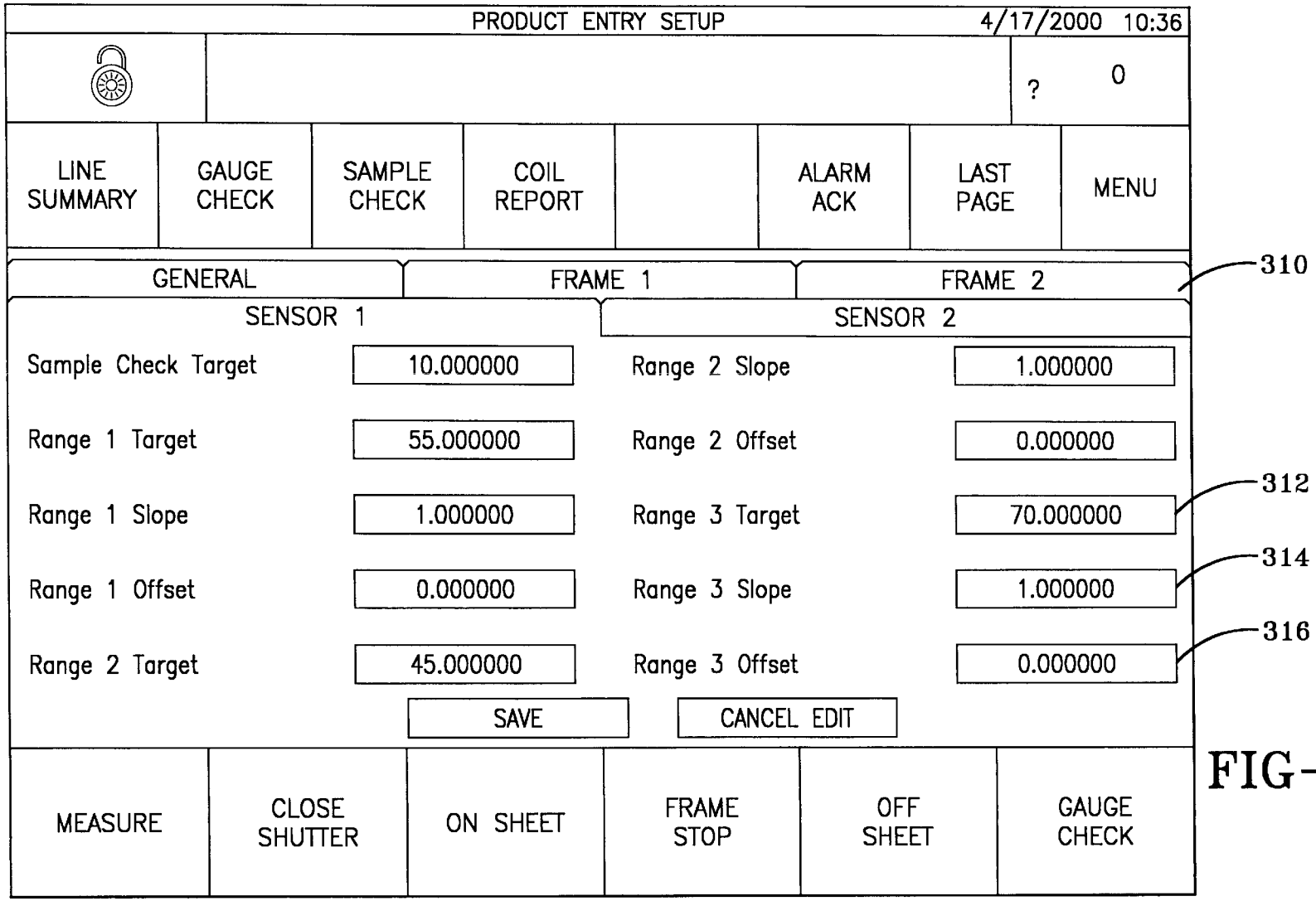

Referring to FIG. 14, a product entry setup screen for an example embodiment of the present invention is shown. The product entry setup screen "General" tab allows the mill quality control operator to specify targets, limits, and alloy or grade characteristics of each product or grade that will be measured by the system. A product code and density as well as a frame target thickness and width may be specified 300. Each product/grade is assigned a separate "Product File" containing this information. When a product is being measured, its "Product File" is read into the system computer and the data is used by the measurement and calculation software to insure correct and accurate measurements and calculations in accordance with the targets and limits that are specified. Referring to FIG. 15, the product entry setup screen "Frame" tab for an example embodiment of the present invention is shown. If a second frame is present, a second tab may be selected to enter data for the second frame. For each sensor within a frame, three thickness ranges may be specified. A slope value and an offset value may be specified for each of the three thickness ranges. Each slope value and offset value within a range is used in calculating a thickness value according to the method described in FIGS. 3A–3C. The target value within each range identifies a breakpoint indicating which slope value and offset value should be used in a thickness value calculation. For example, as shown in FIG. 15, if the target thickness is 70 or above 312, the Range 3 Slope value 314 and Range 3 Offset value are used in calculating thickness values.

Figure 16:
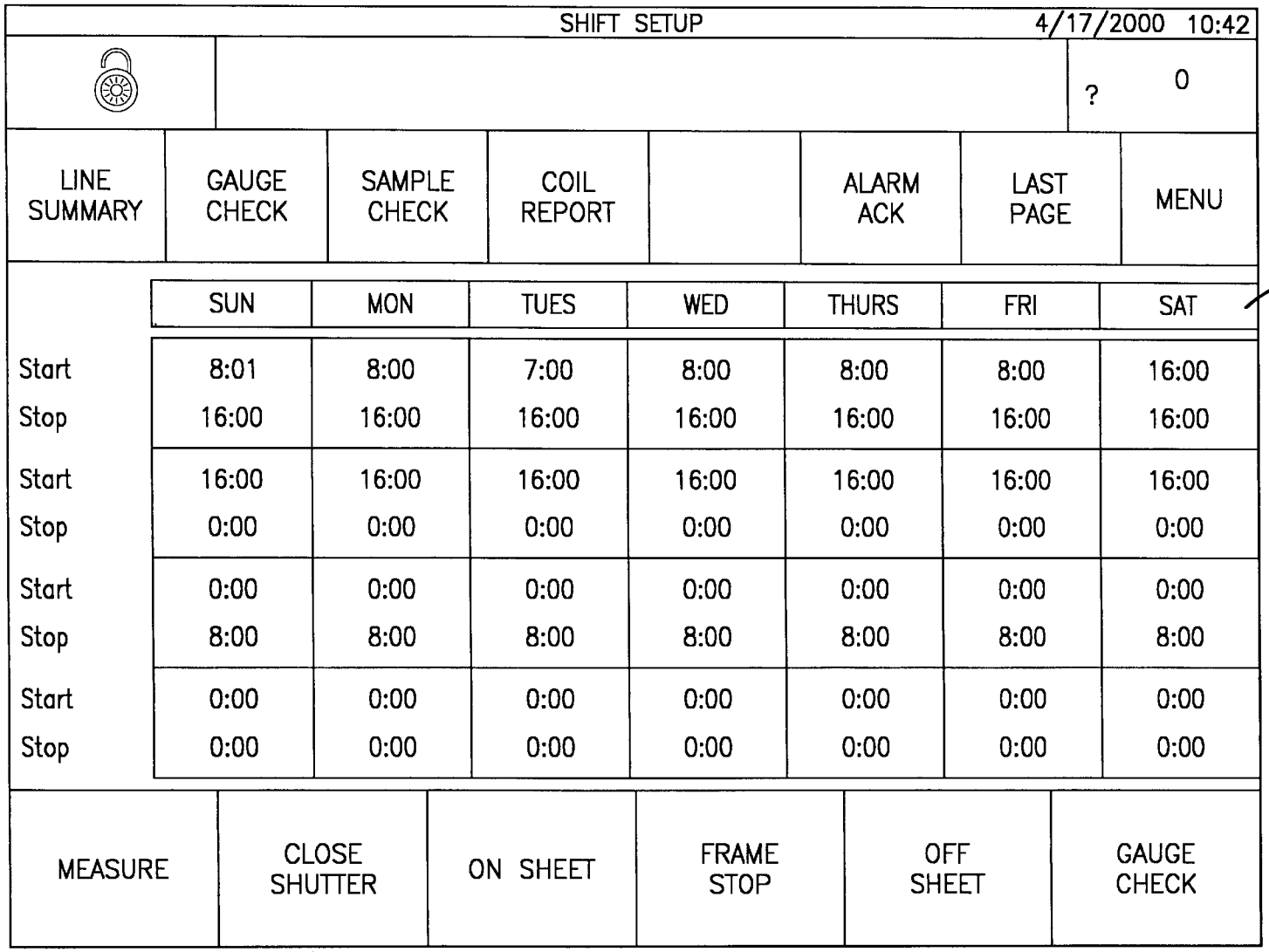

Referring to FIG. 16, a shift setup screen for an example embodiment of the present invention is shown. The shift setup screen allows an operator to enter the start and stop times of each shift for each day of the week. These times are used by the system to determine when to create a previous shift file, copy the former previous shift file to the oldest shift file, and when to start new shift data accumulations.

Referring to FIG. 17, a sample check screen for an example embodiment of the present invention is shown. Selecting the sample check display button initiates a sensor correlation check. It may be used by an operator to measure samples of a process sheet. Sample checks are performed with the samples supplied by the sensor vendor that are initially used for the original correlation of the sensor. Alternatively, process samples of a known alloy and a known, true thickness as determined by laboratory measurements may be used.

To complete the sensor correlation check, an operator cleans the source and detector windows and mounts a sample holder (without the sample) in the sensor air gap. Next, the operator performs a gauge check by selecting the gauge check command from the bottom row of the screen 334. After ensuring the sensor shutter is closed, the sample to be measured is mounted on the sample holder. The operator then enters the sample's actual thickness on the screen. Next, the operator enters a sample name and product alloy or grade designation respectively, if it is different than that currently displayed. Next, the operator selects the sample check button on the top row of the screen 330. When the measurements are complete for each sample to be measured, the operator ensures the sensor shutter is closed, removes the sample holder, and performs a gauge check. Following the sample check, the system may return to normal operation.

INDUSTRIAL APPLICABILITY

The present invention assists in the production of flat sheet products such as metals and plastics. The thickness of the product is monitored and evaluated throughout the mill process to ensure it conforms to specifications. Nonconformances are detected and corrected during the production process resulting in less scrap and wasted production time.

While particular embodiments of the invention have been illustrated and described, various modifications and combinations can be made without departing from the spirit and scope of the invention, and all such modifications, combinations, and equivalents are intended to be covered and claimed.

What is claimed is:

1. A system for measuring the thickness of a flat sheet comprising:

a source/detector unit for collecting sensor measurement data;

a calculation device for calculating true thickness values at a plurality of locations along the length of said flat sheet based on said sensor measurement data from said source/detector unit;

a computer for receiving said thickness values from said calculation device, each of said thickness values correlated with a particular position on said flat sheet; and an operator display unit at said computer for displaying said thickness values.

2. The system of claim 1 wherein said calculation device is a data acquisition processor board.

3. The system of claim 1 further comprising an analog-to-digital converter for converting analog measurement data from said source/detector unit to digital measurement data for processing at said calculation device.

4. The system of claim 1 further comprising a process control system for receiving error signal output from said calculation device.

5. The system of claim 4 wherein said error signal output is selected from the group consisting of actual, average, and exponentially filtered values representing the error values of calculated thicknesses and a target thickness.

6. The system of claim 1 further comprising a deviation meter adapted to display a thickness value as a deviation from a specified target thickness value.

7. The system of claim 1 wherein said operator display unit comprises a touch screen interface.

8. The system of claim 7 wherein said touch screen interface comprises application buttons for selecting software applications and command buttons for issuing commands to production devices.

9. The system of claim 1 wherein said calculation device is adapted to compare thickness values to a target thickness value and to communicate with at least one production device if said thickness values are outside specified limits for said target thickness value.

10. A method for measuring the thickness of a flat sheet comprising the steps of:

(a) at a calculation device, performing a gauge check to determine a first average reading for zero reading sensor data and a second average reading for maximum reading sensor data;

(b) subtracting said first average reading from said second average reading;

(c) apply a natural log calculation to the results of step (b);

(d) determining an incremental length value of said flat sheet;

(e) sampling measurement values for said flat sheet;

(f) subtracting said first average reading from said measurement values;

(g) applying a natural log calculation to the results of step (f);

(h) subtracting the results of step (f) from the results of step (c);

(i) applying external compensations and corrections to results of step (h);

(j) applying an additional linearization calculation involving a polynomial to the results of step (i) to obtain raw thickness values;

(k) calculating true thickness values as raw thickness values times a product slope factor plus a product offset factor;

(l) calculating an average value of true thickness values for said incremental length value; and (m) transferring said average value of true thickness values from said calculation device to a software application at a computer.

11. The method of claim 10 wherein the step of applying an additional linearization calculation involving a polynomial to the results of step (l) comprises the step of applying an additional linearization calculation involving a $5^{th}$ order polynomial.

12. The method of claim 10 further comprising the step of comparing at said calculation device said average value of true thickness values to a target thickness value and communicating with a production device if said average value of true thickness values is outside specified limits for said target thickness value.

13. The method of claim 10 further comprising the step of displaying at said computer a trend graph comprising data points representative of average values of true thickness values compared to a target thickness value.

14. The method of claim 10 wherein the step of performing a gauge check to determine a first average reading for zero reading sensor data and a second average reading for maximum reading sensor data comprises the steps of:

(i) initiating from said calculation device to a sensor a request for zero reading sensor data;

(ii) transferring from said sensor to said calculation device said zero reading sensor data;

(iii) calculating at said calculation device said first average reading for said zero reading sensor data;

(iv) initiating from said calculation device to said sensor a request for maximum reading sensor data;

(v) transferring from said sensor to said calculation device said maximum reading sensor data; and (vi) calculating at said calculation device said second average reading for said maximum reading sensor data.

15. The method of claim 10 wherein the step of determining an incremental length value of said flat sheet comprises the step of calculating the incremental length value from an assigned speed analog-to-digital input that indicates the length per minute said flat sheet is processed.

16. A method for measuring the thickness of a flat sheet comprising:

calculating at a calculation device a plurality of thickness values along the length of said flat sheet based on sensor measurement data;

correlating each of said thickness measurements with a particular position on said flat sheet;

transferring said thickness values from said calculation device to a computer; and displaying data related to said thickness values on an operator display unit at said computer;

whereby the thickness of said flat sheet at a particular position thereon can be observed.

17. The method of claim 16 wherein the step of calculating at a calculation device thickness values for said flat sheet based on sensor measurement data comprises the step of calculating said thickness values at a data acquisition processor board.

18. The method of claim 16 further comprising the step of transmitting to a process control system error signal output based on said thickness values.

19. The method of claim 17 wherein said error signal output is selected from the group consisting of actual, average, and exponentially filtered values representing the error values of calculated thicknesses and a target thickness.

20. The method of claim 16 further comprising step of displaying at a deviation meter said thickness values as a deviation from a target thickness value.

21. The method of claim 16 wherein the step of displaying data related to said thickness values on an operator display unit at said computer comprises the step of displaying thickness values in accordance with a touch screen interface.

22. The method of claim 16 wherein said touch screen interface comprises application buttons for selecting software applications and command buttons for issuing commands to production devices.

23. The method of claim 16 further comprising the steps of comparing at said calculation device said thickness values to a target thickness value and transmitting a signal to a production device if thickness values are outside specified limits for said target thickness value.

24. A method in a computer system for displaying thickness values for a flat sheet comprising the steps of:

displaying on a vertical axis a plurality of thickness values within a range of numbers;

displaying on horizontal axis a plurality of numbers relating to positions on said flat sheet; and for each position on said flat sheet, displaying an indicator representing a calculated thickness value corresponding to said position on said flat sheet.

25. The method of claim 24 further comprising the step of displaying a visual indication of a target thickness value for said flat sheet.

26. The method of claim 24 further comprising the step of displaying an error message if a calculated thickness value exceeds an upper or lower bound for a target thickness value.

27. A system for measuring the thickness of a flat sheet comprising:

a source/detector unit for collecting sensor measurement data;

a calculation device for calculating thickness values for said flat sheet based on said sensor measurement data from said source/detector unit;

a computer for receiving thickness values from said device;

an operator display unit at said computer for displaying said thickness values; and a process control system for receiving error signal output from said calculation device;

wherein said error signal output is selected from the group consisting of actual, average, and exponentially filtered values representing the error values of calculated thicknesses and a target thickness.

28. The system of claim 27 further comprising a strip chart recorder adapted to produce a hard copy record of said thickness values.

29. The system of claim 27 wherein said computer comprises a line summary application, a gauge check application, a sample check application, and a coil report application.

30. A system for measuring the thickness of a flat sheet comprising:

a source/detector unit for collecting sensor measurement data;

a calculation device for calculating thickness values for said flat sheet based on said sensor measurement data from said source/detector unit;

a computer for receiving thickness values from said device;

an operator display unit at said computer for displaying said thickness values; and a deviation meter adapted to display a thickness value as a deviation from a specified target thickness value.

31. A method for measuring the thickness of a flat sheet comprising:

calculating at a calculation device thickness values for said flat sheet based on sensor measurement data;

transferring said thickness values from said calculation device to a computer;

displaying data related to said thickness values on an operator display unit at said computer; and transmitting to a process control system error signal output based on said thickness values;

wherein said error signal output is selected from the group consisting of actual, average, and exponentially filtered values representing the error values of calculated thicknesses and a target thickness.

32. The method of claim 31 further comprising the step of producing at a strip chart recorder a hard copy record of said thickness values.

33. The method of claim 31 further comprising the step of selecting a software application from the group consisting of a line summary application, a gauge check application, a sample check application, and a coil report application.

34. A method for measuring the thickness of a flat sheet comprising:

calculating at a calculation device thickness values for said flat sheet based on sensor measurement data;

transferring said thickness values from said calculation device to a computer;

displaying data related to said thickness values on an operator display unit at said computer; and comparing at said calculation device said thickness values to a target thickness value and transmitting a signal to a production device if thickness values are outside specified limits for said target thickness value.

* * * * *